US007044479B2

(12) United States Patent
Campbell, Jr. et al.

(10) Patent No.: US 7,044,479 B2
(45) Date of Patent: May 16, 2006

(54) STEEL RETAINER FOR ROCK DRILL

(76) Inventors: Paul B. Campbell, Jr., 271 Laymantown Rd., Troutville, VA (US) 24175-6715; Colin D. Campbell, 271 Laymantown Rd., Troutville, VA (US) 24175-6715

( * ) Notice: Subject to any disclaimer, the term of this patent is extended or adjusted under 35 U.S.C. 154(b) by 0 days.

(21) Appl. No.: 10/179,718

(22) Filed: Jun. 25, 2002

(65) Prior Publication Data

US 2002/0195779 A1 Dec. 26, 2002

Related U.S. Application Data

(60) Provisional application No. 60/300,891, filed on Jun. 25, 2001.

(51) Int. Cl.
*B25D 17/08* (2006.01)

(52) U.S. Cl. ..... 279/19.1; 279/77

(58) Field of Classification Search ..... 279/19–19.7, 279/77, 89; 403/316, 375, 321, 322.4, 325, 403/328, 330; B25D 17/08
See application file for complete search history.

(56) References Cited

U.S. PATENT DOCUMENTS 1,119,330 A * 12/1914 Wakfer ..... 74/127
1,212,576 A * 1/1917 Sinclair ..... 279/19.1
1,503,932 A * 8/1924 Wilhelm et al. ..... 279/19.1
1,612,784 A * 12/1926 Gartin ..... 279/19.1
1,675,432 A * 7/1928 Smith ..... 279/19.1
1,753,249 A * 4/1930 Pearson ..... 279/19.1
1,800,377 A * 4/1931 Downing ..... 279/19.1
1,865,340 A * 6/1932 Slatcher ..... 279/19.1
1,967,500 A * 7/1934 Curtis ..... 279/19.1
2,114,047 A * 4/1938 Curtis ..... 279/19.1
2,406,132 A * 8/1946 Calaman ..... 279/19.1
2,958,534 A * 11/1960 Fuehrer ..... 279/19.1
3,454,284 A * 7/1969 Moores, Jr. ..... 279/19.1
5,330,202 A * 7/1994 Kimberlin et al. ..... 279/19.4

FOREIGN PATENT DOCUMENTS

GB 2093378 * 9/1982

OTHER PUBLICATIONS 698 1999 Tamco Catalog p. 26.
52278D 1999 Ingersoll—Rand Catalog.
2001 Boart Longyear HD1704.

* cited by examiner

*Primary Examiner*—Daniel W. Howell

(57) ABSTRACT

A simple and positive drill steel retainer comprises a retainer and a latch. The retainer cannot be opened until the latch is disengaged. The latch is held in the engaged position by a spring. The retainer and latch can be easily operated with one hand.

2 Claims, 10 Drawing Sheets

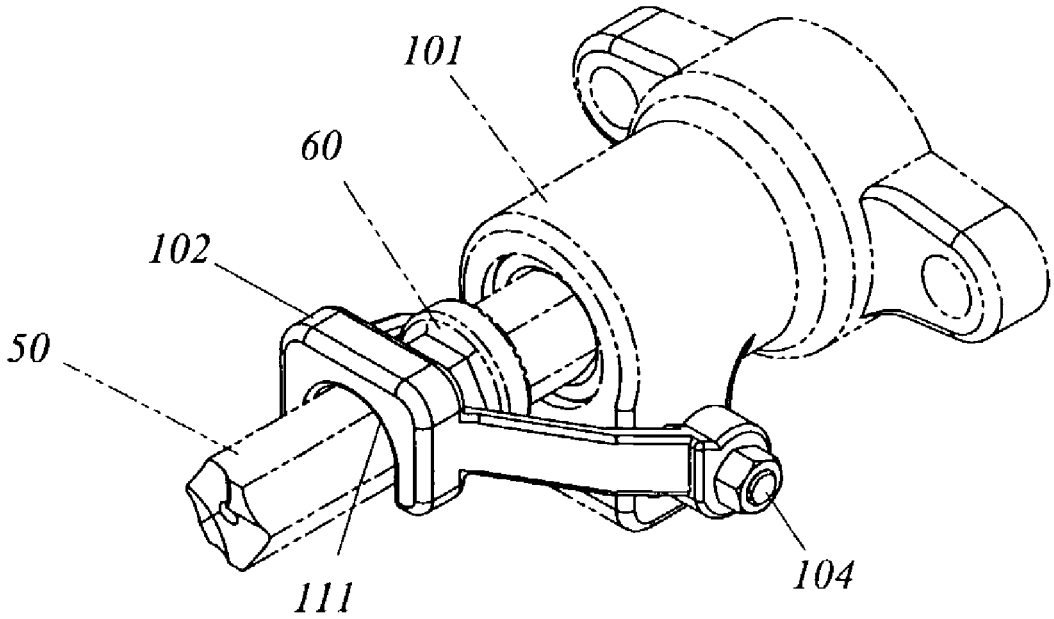
Figure 2, Prior Art
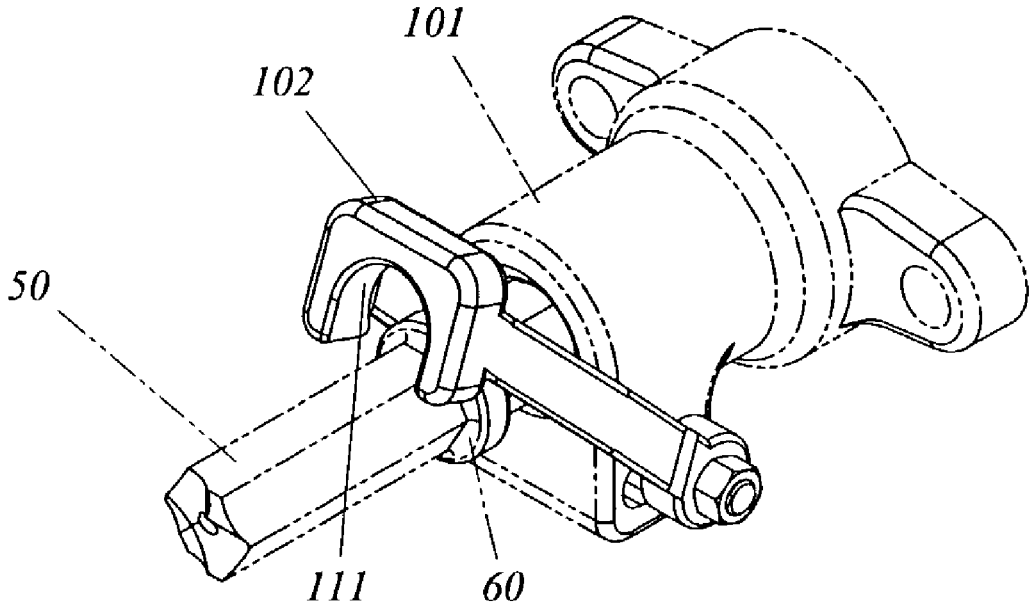
Figure 3, Prior Art

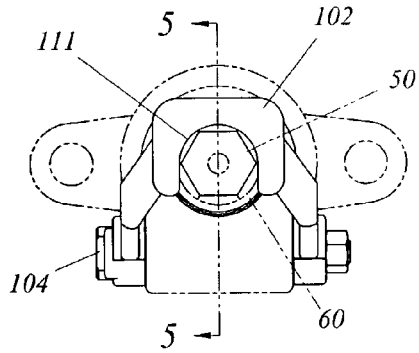
Figure 4, Prior Art
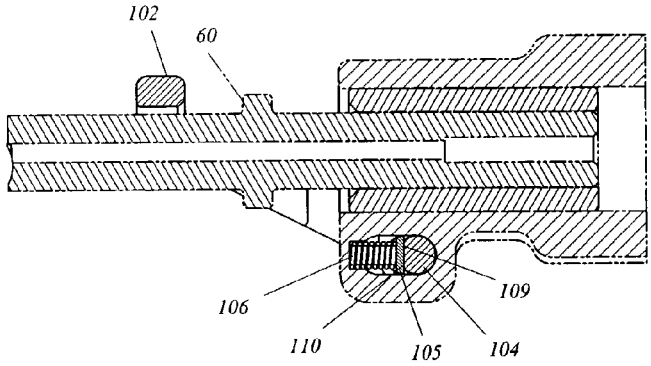
Figure 5, Prior Art
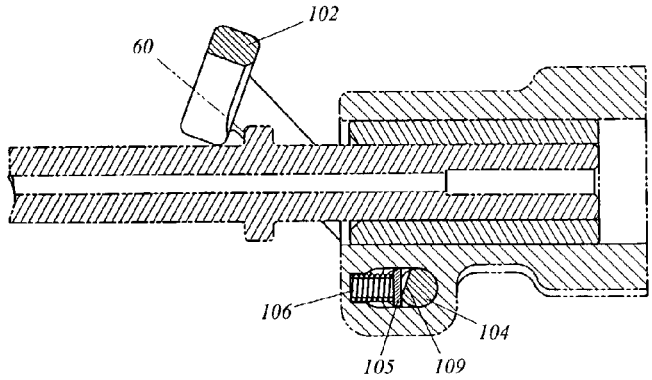
Figure 6, Prior Art

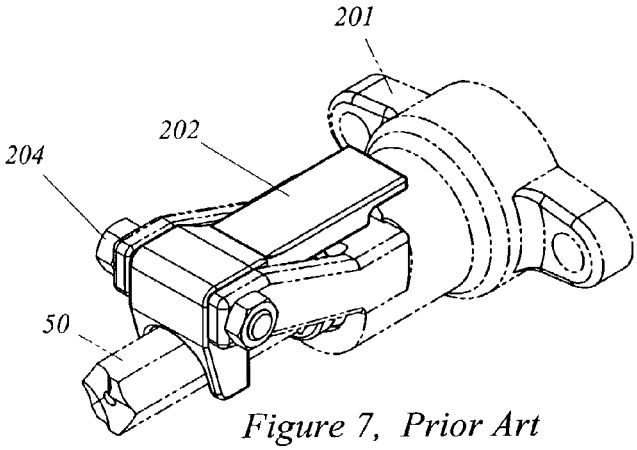
Figure 7, Prior Art
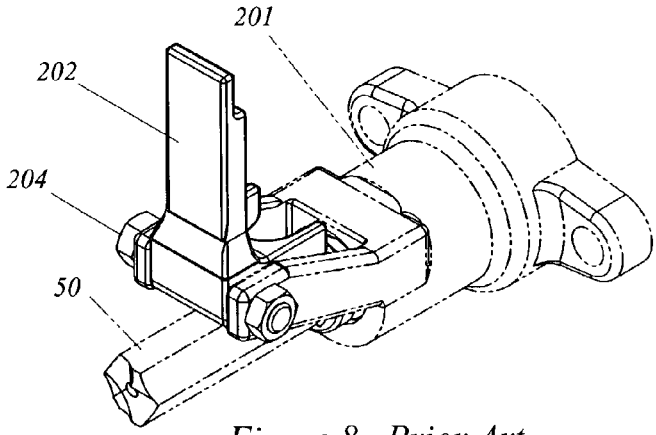
Figure 8, Prior Art
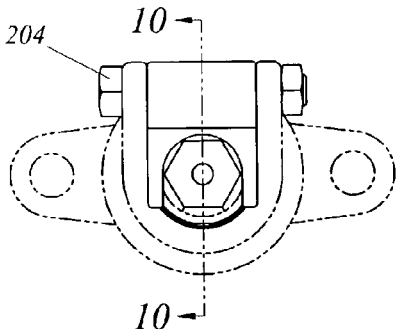
Figure 9, Prior Art

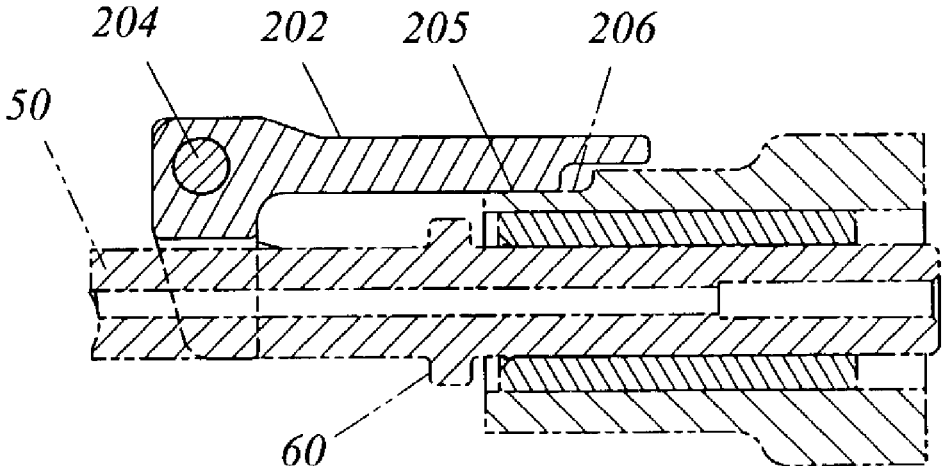
*Figure 10, Prior Art*
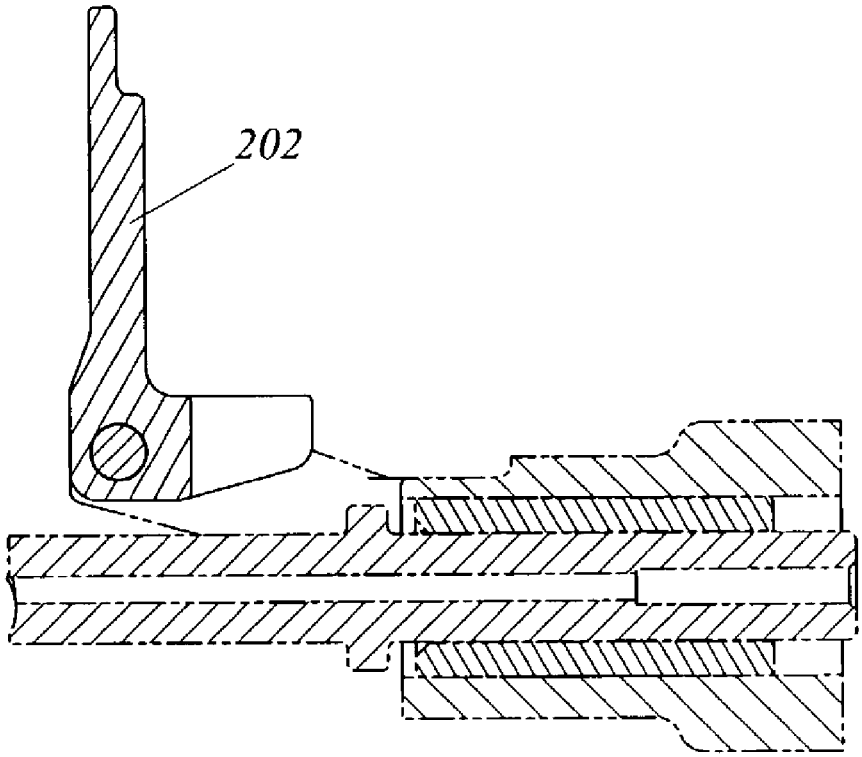
*Figure 11, Prior Art*

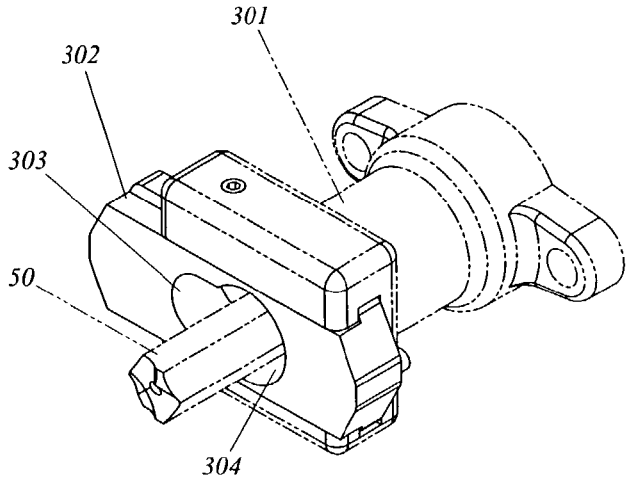
Figure 12, Prior Art
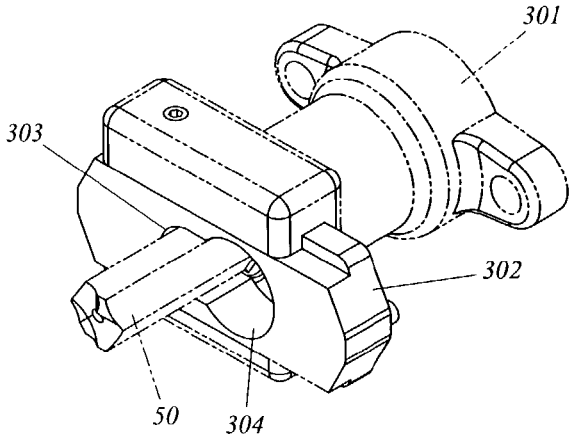
Figure 13, Prior Art
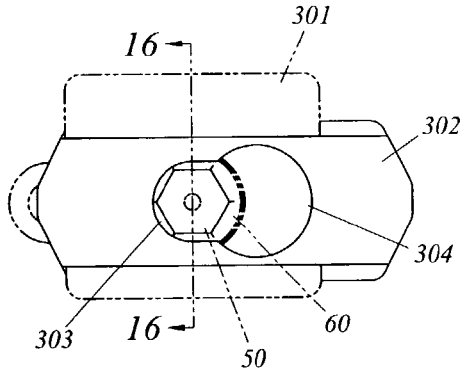
Figure 14, Prior Art

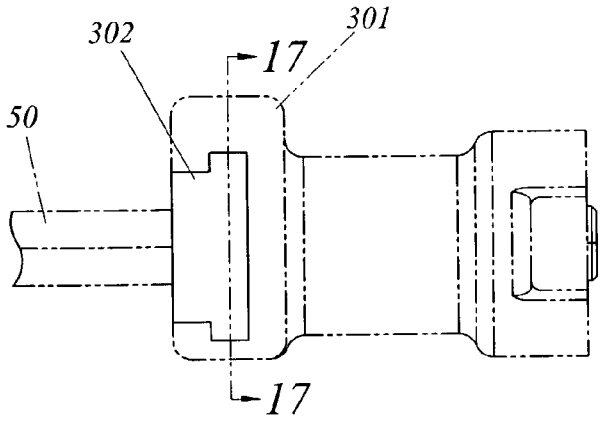
Figure 15, Prior Art
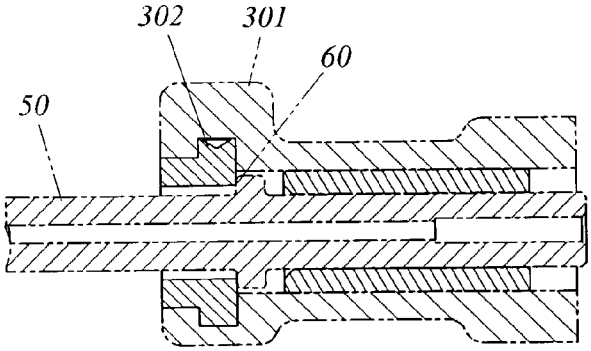
Figure 16, Prior Art
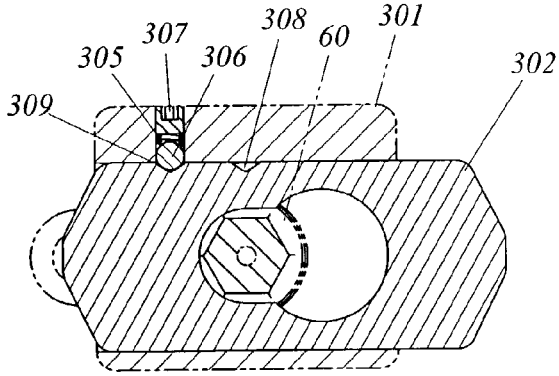
Figure 17, Prior Art

STEEL RETAINER FOR ROCK DRILL

CROSS-REFERENCE TO RELATED APPLICATIONS

This invention is used on the hydraulic rock drill of co-pending applications entitled "Operating System for Hydraulic Rock Drill" and "Valve for Hydraulic Rock Drill", both filed 2002 Jun. 25. This application is entitled to the benefit of Provisional Patent Application Ser. No. 60/300,891, filed 2001 Jun. 25.

BACKGROUND

1. Field of Invention

This invention relates specifically to a retaining device for drill steels used on percussive rock drills.

2. Description of Prior Art

Every percussive rock drill includes certain basic features. A striking piston imparts impact energy to a drill steel and bit, a rotation mechanism causes the drill steel to rotate to give the bit a fresh rock surface to strike with each blow, and a drill steel retention mechanism allows removal of the drill steel and bit when the hole is completed.

Manufacturers of small drilling rigs, designed to drill holes in the range of 1¼ to 2 inch diameter, typically use hand-held drills that are modified for mounted use. Modifications may be as simple as removing handles and locking control valves in the "on" position. Hand-held drills have a variety of drill steel retainer designs, each with its own disadvantages. One type is too weak to resist the pulling force of a mounted arrangement. A second type can withstand a strong pulling force but sometimes cannot be opened if the drill steel becomes stuck in the drilled hole. A third type can withstand a strong pulling force but is difficult to open and expensive to manufacture.

SUMMARY

The object of the present invention is to provide a simple and positive drill steel retention method, capable of withstanding strong pulling forces while being easy to open.

DRAWING FIGURES

FIG. 2 is a perspective view of a prior art steel retainer in the engaged position.

FIG. 3 is a perspective view of a prior art steel retainer in the disengaged position.

FIG. 4 is a front view of a prior art steel retainer in the engaged position.

FIG. 5 is a cross-section view of a prior art steel retainer in the engaged position.

FIG. 6 is a cross-section view of a prior art steel retainer in the disengaged position.

FIG. 7 is a perspective view of a second prior art steel retainer in the engaged position.

FIG. 8 is a perspective view of a second prior art steel retainer in the disengaged position.

FIG. 9 is a front view of a second prior art steel retainer in the engaged position.

FIG. 10 is a cross-section view of a second prior art steel retainer in the engaged position.

FIG. 11 is a cross-section view of a second prior art steel retainer in the disengaged position.

FIG. 12 is a perspective view of a third prior art steel retainer in the disengaged position.

FIG. 13 is a perspective view of a third prior art steel retainer in the engaged position.

FIG. 14 is a front view of a third prior art steel retainer in the engaged position.

FIG. 15 is a side view of a third prior art steel retainer.

FIG. 16 is a cross-section view of a third prior art steel retainer in the engaged position.

FIG. 17 is a cross-section view of a third prior art steel retainer in the engaged position.

DESCRIPTION

Figure 1:
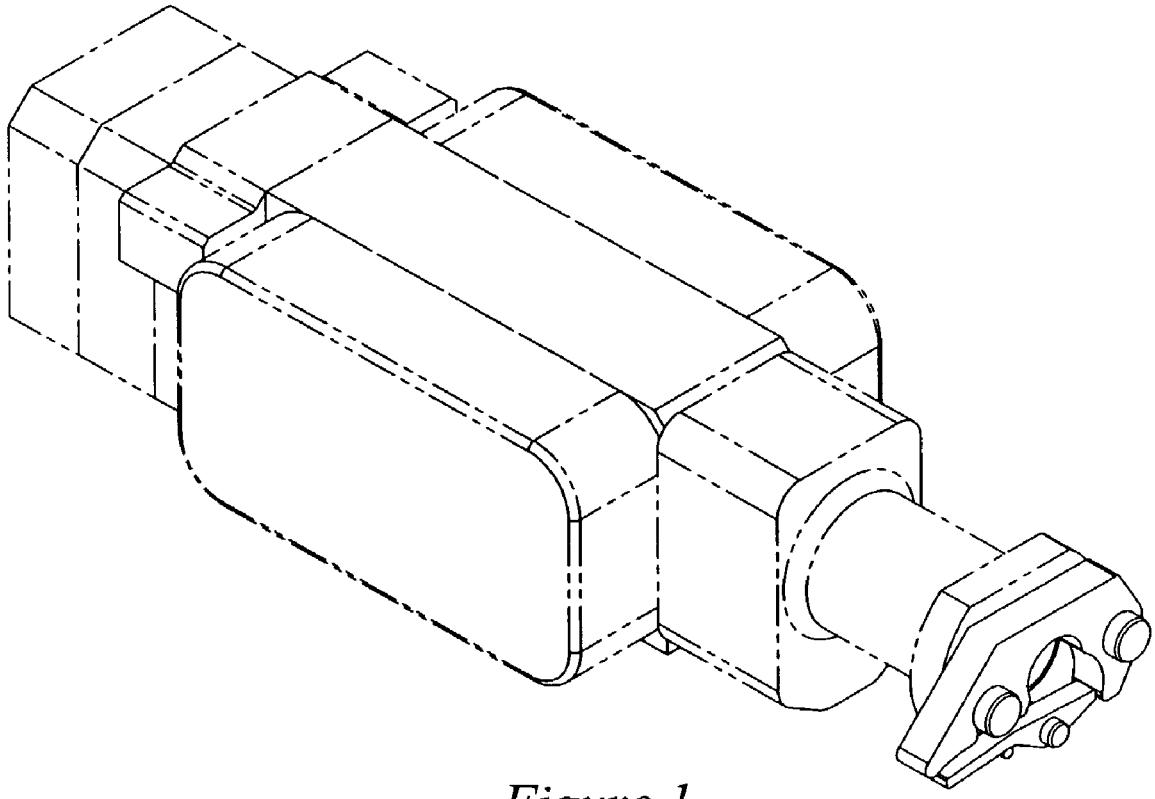
FIG. 1 is a perspective view of a rock drill that embodies the object of this invention.

Conventional drill steel retainers for hand-held drills may be placed into three general classifications with certain common characteristics. The most significant common characteristic is the lack of full circle contact between the retainer and the drill steel locating shoulder. This characteristic may be clearly seen by referring to FIGS. 2, 3, and 4. Shoulder 60 positively locates drill steel 50 during drilling and while retracting from a drilled hole. Opening 111 in retainer 102 is in the form of a circle with one side removed. When shoulder 60 is pulled against retainer 102 during retraction of drill steel 50 from a drilled hole, as in FIG. 2, the non-symmetrical loading between shoulder 60 and retainer 102 urges retainer 102 toward an open position as in FIG. 3. It is not uncommon for retainer 102 to open suddenly while trying to retract drill steel 50. The result is lost productivity, excessive wear on components, and possibly a lost drill steel. Examples of prior art drill steel retainers illustrate various methods of keeping a retainer closed during use. The subject invention shows a superior way of keeping the retainer closed during use while allowing ease of opening when desired.

The first type of drill steel retainer is frequently referred to as a "yoke" retainer. FIGS. 2 through 6 show a typical example, although there are many variations. Retainer 102 is attached to housing 101 by bolt 104, which has a flat surface 109. Retainer 102 is held in the closed position by a spring 106 and cam 110 acting against surface 109. Bolt 104 is constrained to rotate with retainer 102 about the centerline of bolt 104. When attempting to retract a drill bit and drill steel from a drilled hole, retainer 102 contacts shoulder 60 on drill steel 50 and transfers the retracting force to drill steel 50. FIGS. 3 and 6 show retainer 102 in an open position. With retainer 102 in the open position, shoulder 60 on drill steel 50 encounters no resistance and may be easily removed from housing 101. FIG. 6 clearly shows that the rotation of surface 109 has caused spring 106 to be compressed, creating a closing force on retainer 102. The primary disadvantage of the "yoke" retainer is that the force holding the retainer closed is small and is easily overpowered. When the steel and bit are being retracted from a drilled hole by an operator's lifting efforts, the "yoke" retainer is usually strong enough. In a mounted application, the drill feed mechanism is capable of pulling much harder. Stronger pulling force is an advantage if the drill steel and bit become stuck, but the "yoke" retainer frequently pops open when subjected to this higher force and is incapable of withdrawing the drill steel and bit. If the geometry of the spring and cam mechanism is changed to provide more resistance to opening during operation, this same resistance makes the "yoke" retainer more difficult to open when removing the drill steel.

The second type of drill steel retainer is frequently referred to as a "beavertail" retainer. FIGS. 7 through 11 show a typical example, although there are many variations. Retainer 202 is attached to housing 201 by bolt 204. In the closed position as shown in FIGS. 7, 9, and 10, any pulling force exerted by shoulder 60 of drill steel 50 causes retainer 202 to try to rotate around bolt 204. This rotational force is resisted by shoulder surface 205 on retainer 202 as it rests against surface 206 on housing 201. The "beavertail" retainer cannot be overpowered by a large pulling force because the pulling force urges the retainer toward a closed position. The primary disadvantage of the "beavertail" retainer is the possibility that it may become jammed in the closed position if drill steel 50 has been driven into the ground until drill steel shoulder 60 contacts retainer 202, and the drill bit becomes stuck. The pivoting action of the "beavertail" retainer around bolt 204 when being opened will move the drill steel backwards toward the drill. If the drill steel cannot move, the retainer cannot be opened. FIGS. 8 and 11 show retainer 202 rotated to the open position.

The third type of drill steel retainer may be referred to as a "sliding gate" retainer. FIGS. 12 through 17 show a typical example, although there are many variations. Retainer 302 is slidably mounted in housing 301. Retainer 302 contains an elongated slot consisting of two overlapping holes 303 and 304. Hole 303 is larger than the diameter of drill steel 50 but smaller than the diameter of drill steel shoulder 60. Hole 304 is larger than the diameter of drill steel shoulder 60. FIG. 12 shows retainer 302 in the open position wherein hole 304 is concentric with drill steel 50, and drill steel 50 may be retracted from housing 301. FIG. 13 shows retainer 302 in the closed position wherein hole 303 is concentric with drill steel 50, and drill steel 50 is retained in housing 301 by contact between drill steel shoulder 60 and retainer 302. When attempting to retract a drill bit and drill steel from a drilled hole, retainer 302 contacts shoulder 60 on drill steel 50 and transfers the retracting force to drill steel 50. FIG. 17 shows the mechanism by which retainer 302 is held in the open or closed position. Ball 306 is loaded by spring 305, and spring 305 is retained by plug 307. When retainer 302 is in the closed position ball 306 protrudes into depression 309, and retainer 302 can only be moved out of the closed position by overcoming the force exerted on ball 306 by spring 305. When retainer 302 is in the open position ball 306 protrudes into depression 308, and retainer 302 can only be moved out of the open position by overcoming the force exerted on ball 306 by spring 305. The force required to move retainer 302 out of the open or closed positions may be regulated by varying the force exerted by spring 305. The primary disadvantage of the "sliding gate" retainer is that the force holding the retainer closed is directly related to the force exerted by spring 305. If the geometry of the spring and cam mechanism is changed to provide more resistance to opening during operation, this same resistance makes the "sliding gate" retainer more difficult to open when removing the drill steel. In practice, it is frequently necessary to strike the end of retainer 302 with a heavy object in order to overcome the force exerted by spring 305 on ball 306. A further disadvantage of the "sliding gate" retainer is the manufacturing complexity involved in slidably mounting retainer 302 in housing 301.

Figure 18:
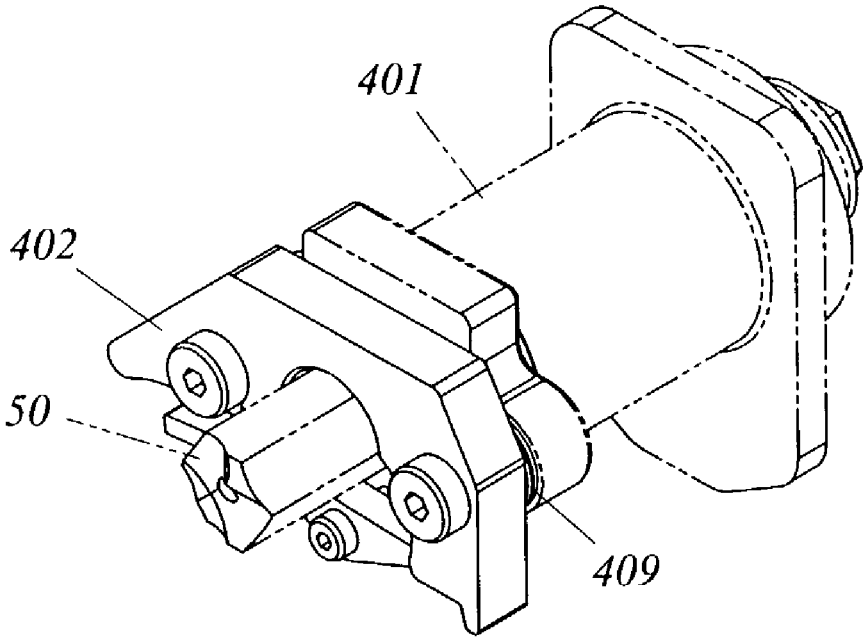
FIG. 18 is a perspective view of the new steel retainer in the engaged position.
Figure 19:
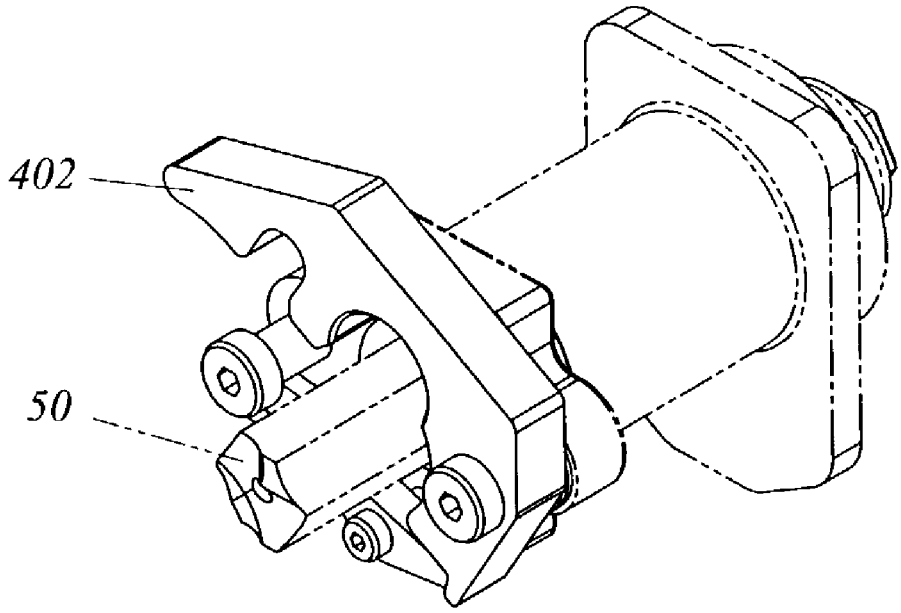
FIG. 19 is a perspective view of the new steel retainer in the disengaged position
Figure 20:
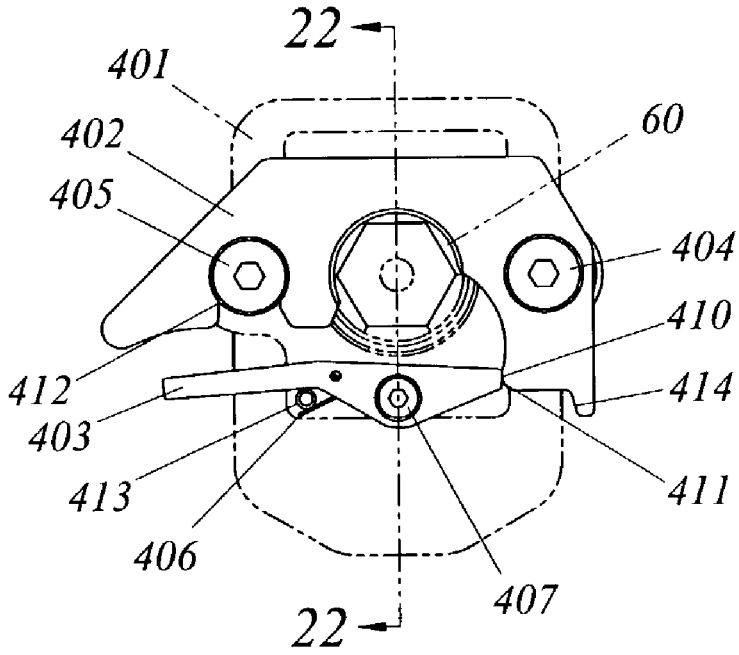
FIG. 20 is a front view of the new steel retainer in the engaged position.
Figure 21:
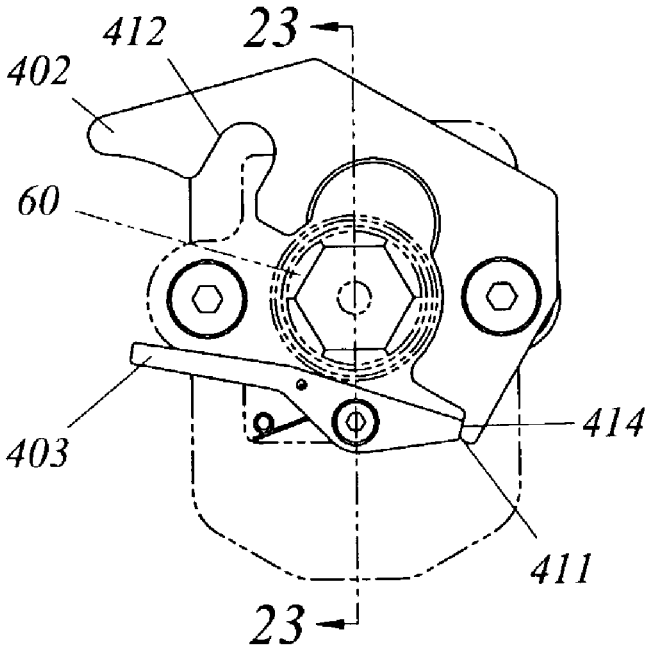
FIG. 21 is a front view of the new steel retainer in the disengaged position.
Figure 22:
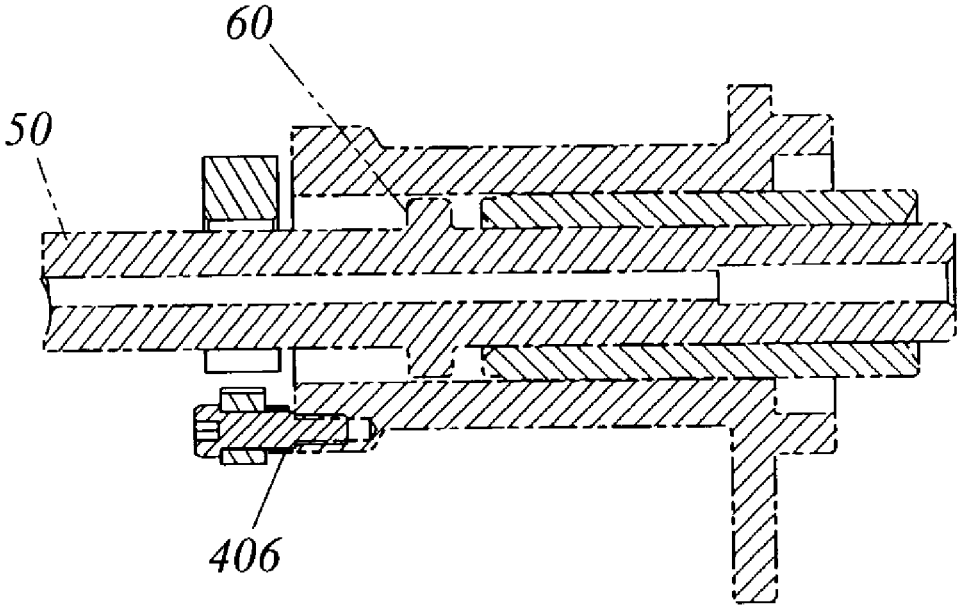
FIG. 22 is a cross-section view of the new steel retainer in the engaged position.
Figure 23:
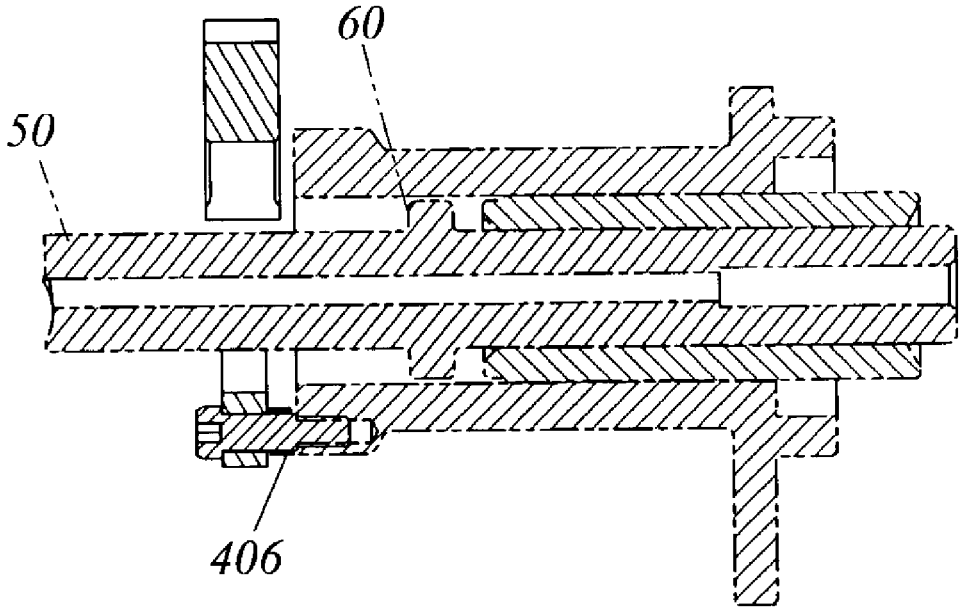
FIG. 23 is a cross-section view of the new steel retainer in the disengaged position.

A superior steel retainer mechanism, the object of this invention, is shown in FIGS. 18 through 23. Retainer 402 is attached to housing 401 by shouldered bolts 404 and 405. Retainer 402 is allowed to pivot around bolt 404, and slot 412 in retainer 402 engages bolt 405. Tensioning device 409, which may be a Belleville spring or other means, prevents retainer 402 from rattling or otherwise experiencing uncontrolled motion. Latch 403 is attached to housing 401 by shouldered bolt 407. Latch 403 is allowed to pivot around bolt 407 but is held against pin 413 by spring 406. Shoulder 411 on latch 403, by contact with shoulder 410 on retainer 402, prevents retainer 402 from being opened. The geometric relationship between shoulder 411 and the center of bolt 407 is such that any force exerted by retainer shoulder 410 on latch shoulder 411 causes latch 403 to rotate in a counterclockwise direction against stop pin 413. Latch 403 thereby provides a positive locking mechanism for retainer 402. When latch 403 is rotated clockwise slightly around bolt 407 against the small force of spring 406, shoulder 411 is no longer engaged against shoulder 410 and retainer 402 can be rotated around bolt 404. When retainer 402 has been rotated sufficiently to bring shoulder 414 in contact with shoulder 411, as in FIG. 21, retainer 402 is fully opened and drill steel 50 can be removed. It may readily be seen that the new steel retainer mechanism shown in these figures is superior to the "yoke" retainer and the "sliding gate" retainer because it provides a positive locking mechanism that is easily opened whenever desired. The new steel retainer mechanism is superior to the "beavertail" retainer because it does not depend on movement of the drill steel in order to be opened. Additional benefits may be seen by recognizing that retainer 402, being essentially a flat plate with a predetermined shape, is much simpler in its geometry than retainer 102, retainer 202, or retainer 302. The simpler geometry of retainer 402 permits a more compact assembly and also reduces manufacturing complexity and cost.

CONCLUSION RAMIFICATIONS, AND SCOPE

The reader will see that the drill steel retainer of the invention provides a positively locking device that will not open under load yet may be easily opened whenever desired. Furthermore, the subject drill steel retainer has additional advantages in that

- it can be opened easily with one hand, without the use of any tools; and
- it is simple in construction and thus easy to manufacture.

Although the description above contains many specificities, these should not be construed as limiting the scope of the invention but as merely providing an illustration of the preferred embodiment of this invention. For example, in the preferred embodiment the retainer pivots around an axis parallel to the axis of the drill steel. In an alternative embodiment the retainer might pivot around an axis perpendicular to or at some other angle to the axis of the drill steel. Likewise in the preferred embodiment the latch pivots around an axis parallel to the axis of the drill steel. In an alternative embodiment the latch might pivot around a different axis or might have a sliding motion rather than a pivoting motion. In the preferred embodiment the retainer and latch are attached to the housing with shouldered bolts.

In an alternative embodiment the retainer and latch might be attached by some other means that allows a free pivoting action.

Thus the scope of the invention should be determined by the appended claims and their legal equivalents, rather than by the examples given.

We claim:

1. A steel retainer for a rock drill for providing a positive and reliable engagement that is also easy to disengage, comprising:

means for retaining a drill steel on a housing;

said drill steel being axially elongated and having an axis extending axially along the drill steel;

said means for retaining being pivotally mounted at one end on a cylindrical member on said housing, said cylindrical member being parallel to the axis of said drill steel;

said means for retaining having a slot on the end opposite said one end;

a stop member parallel to said axis of the drill steel and located on said housing on the opposite side of the drill steel axis than said cylindrical member, said slot engaging the stop member in order to limit how far the means for retaining may pivot, and therefore locate the means for retaining in a position to retain the drill steel;

a pivotable latch for preventing said means for retaining from pivoting out of the position where the slot engages the stop member, a stop pin for limiting one direction of pivoting of the latch, and means for resiliently holding the pivotable latch against said stop pin;

said one end of said means for retaining having a first contact surface, said pivotable latch having a first end having a shoulder which abuts said first contact surface in order to lock said means for retaining in a position to secure said drill steel, said shoulder abutting the first contact surface of said means for retaining when the latch contacts said stop pin; and said one end of said means for retaining having a second contact surface, the shoulder of said pivotable latch abutting said second contact surface when said means for retaining is pivoted to a position where the slot is not engaged with said stop member in order to remove the drill steel, said latch having a second end which is pushed against the means for resiliently holding the pivotable latch to disengage the shoulder of the latch from the first contact surface before the slot may be disengaged from said stop member.

2. A steel retainer as claimed in claim 1, wherein said means for resiliently holding the pivotable latch comprises a spring.

* * * * *